United States Patent [19]

Adell

[11] Patent Number: 4,639,948

[45] Date of Patent: Feb. 3, 1987

[54] HIP BELT

[75] Inventor: Robert Adell, Sunnyvale, Tex.

[73] Assignee: U.S. Product Development Company, Sunnyvale, Tex.

[21] Appl. No.: 734,926

[22] Filed: May 16, 1985

[51] Int. Cl.[4] ..... A41F 3/02

[52] U.S. Cl. ..... 2/338; 2/311; 2/339; D2/633

[58] Field of Search ..... 2/338, 339, 311, 312, 2/325; D2/387, 393

[56] References Cited

U.S. PATENT DOCUMENTS

| | | | |
|---|---|---|---|
| D. 137,555 | 3/1944 | Huff | D2/387 |
| D. 138,344 | 7/1944 | Huff | D2/387 |
| 1,382,446 | 6/1921 | Warren | 2/311 |
| 1,431,846 | 10/1922 | Slavens | 2/338 X |
| 1,719,145 | 7/1929 | Stover | 2/338 |
| 1,792,158 | 2/1931 | Gleckner | 2/338 X |
| 2,539,891 | 1/1951 | Carr et al. | 2/339 |
| 3,295,144 | 1/1967 | Mengers | 2/339 X |
| 3,848,270 | 11/1974 | Rand | 2/311 |

*Primary Examiner*—Werner H. Schroeder
*Assistant Examiner*—J. L. Olds
*Attorney, Agent, or Firm*—Rhodes and Boller

[57] ABSTRACT

A hip belt comprises a number of substantially similar pieces successively connected by snap fasteners. Each individual piece possesses a pliant construction of substantially uniform thickness and has a perimeter edge. The side edge portions of the perimeter edge of each piece impart a taper to the piece. The snap fasteners are located in the end edge portions of the pieces and enable each piece to swivel with respect to its immediately adjacent pieces. When worn, the belt assumes a configuration in which side portions are supported by the wearer's hips. Front and back portions extend from the side portions across the wearer's abdomen and lower back respectively, and they may have slight downward curvatures. In a belt for a typical wearer, there may be from eleven to fifteen of the individual pieces. Various forms of indicia and/or decoration may be imparted to the individual pieces.

19 Claims, 5 Drawing Figures

HIP BELT

BACKGROUND AND SUMMARY OF THE INVENTION

This invention relates to a hip belt.

A typical belt comprises an elongate strip of material for encircling the waist of the wearer along with means for connecting the free ends of the belt together, such as a belt buckle or the like. Adjustment of a belt to fit a particular individual is often accomplished by a series of holes punched along the elongate strip with which the belt buckle is selectively engaged.

Belts can have both functional and decorative characteristics. For example, a belt can be both functional and decorative by providing it with a decorative appearance and with a construction which enables it to be drawn tightly around a wearer so as to support an article of clothing on the wearer, i.e. trousers or a skirt.

Alternatively a belt can be principally decorative when an associated article of clothing relies on another means of support. For example, a trousers or skirt could have an elastic waist band which provides the support, and an associated belt can be merely decorative although it might provide some degree of incidental support.

When a belt is fabricated as an elongate strip of material, several feet of such material is required, a typical length being approximately 2½ to 3½ feet.

Where belts are made from a natural source, i.e. leather, this requirement may impose a constraint on the number of strips which can be cut from a given piece of raw material.

A more efficient use of such raw material can be made by constructing a belt from a number of smaller individual pieces which are then connected together.

One of the advantages of the present invention is that the belt is constructed from a number of individual pieces of material, and it is therefore more efficient in the use of such raw material.

Another aspect of the invention is that it is wellsuited for conformance with an individual user, particularly as a hip belt. An associated article of clothing will usually not have this particular shape of conformance, and therefore the belt of the present invention may be considered to be primarily decorative rather than possessing the principally functional attribute of supporting the associated article of clothing, such as slacks or a skirt. Principles of the invention however may be applicable to a belt which performs an article support function.

The invention comprises in the preferred embodiment a number of individual pieces which are successively connnected together. The individual pieces have particular shapes, sizes, and means of connection which endow the belt with its ability to conform to the configuration of the individual as a hip belt.

Moreover, the individual pieces are of a size which renders them suited for the inscription of decoration and/or indicia to promote a desired appearance.

Furthermore, because the individual pieces are of substantially identical size and shape in a given belt, it is possible to replace individual pieces so that decorative designs can be changed from time to time by the particular individual. A particularly advantageous way of commercializing the belt is by packaging it in an enclosure or wrap containing a number of the individual pieces stacked together. They may have identical or differing designe. The purchaser may buy selected ones of these packages for the purpose of creating desired belt patterns with full assurance that the individual pieces will fit together. Of course a belt could be sold in forms other than a package of stacked pieces, and it is possible to sell a number of pieces already connected together as a belt, or to sell individual unconnected pieces.

It is also possible to construct a belt embodying principles of the invention without the need to have an accompanying belt buckle or equivalent means of connecting the ends together because the individual pieces themselves contain connecting means for making the connections of the free ends. Because the entire belt is constructed of like individual pieces separably connected together, any one of the connections may be broken to enable the user to adjust the belt to dispose respective pieces of the belt at particular locations along the length of the belt to yield a desired appearance when it is being worn.

Moreover in the disclosed preferred embodiment of the invention, the particular unique organization and arrangement provides for the belt to conform to individuals without necessarily having to have a piece which is unlike the others, although obviously one might choose to insert a dissimilar piece or pieces into the belt. For example a belt constructed of a particular number of individual identical pieces may be adapted for an individual having a particular nominal girth. Because of the ability of the belt to conform to different body shapes as will be seen in more detail herein after, a particular belt containing a particular number of pieces can accommodate individuals having girths slightly greater and slightly lesser than the nominal figure, but if the accommodation were deemed not exactly correct, then it is possible to either insert or remove an odd piece into or from the belt so that a closer fit can be obtained.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
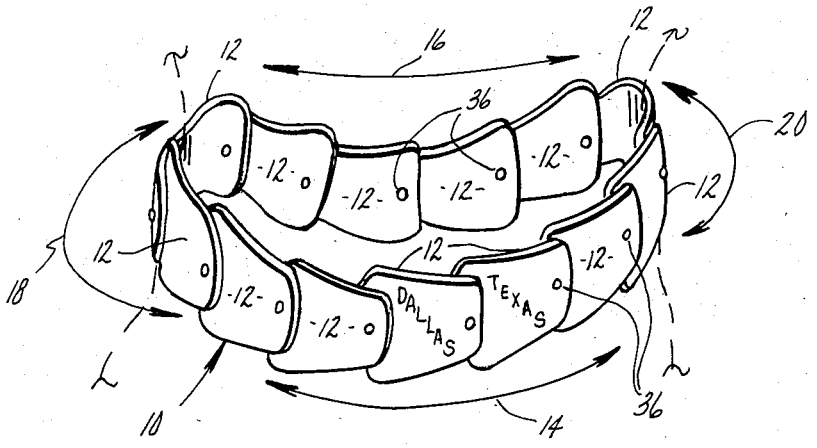
FIG. 1 is a perspective view illustrating a belt embodying principles of the present invention.

FIG. 1 illustrates a presently preferred embodiment of a hip belt 10 embodying principles of the present invention. Belt 10 comprises thirteen individual pieces 12 which will accommodate a typical individual. FIG. 1 further illustrates the approximate form which the belt will assume when worn by an individual. The outline of the individual is shown by the broken lines.

The frontal portion of belt 10 which extends along the region identified by the reference numeral 14 will be disposed against the wearer's abdomen and typically have a slight downward curvature along the length of the belt as illustrated. The portion extending along the region designated by the reference numeral 16 will be disposed against the back of the wearer and may typically also have a slight downward curvature. The two portions of the belt designated by the regions 18 and 20 respectively curve around the sides of the wearer and have the greatest degree of curvature of any of the individual pieces of the belt since they must make the transition between the frontal and the back regions 14 and 16.

The two regions 18 and 20 will be disposed against the sides of the wearer, overlying and disposed against the top sides of the hips. When the belt is worn, the regions 18 and 20 will be prevented from falling downward by virtue of their support by the hips. The regions 14 and 16 will extend between them and have the tendency to curve downwardly as shown. Thus the belt is well suited for conformance to an individual.

Figure 2:
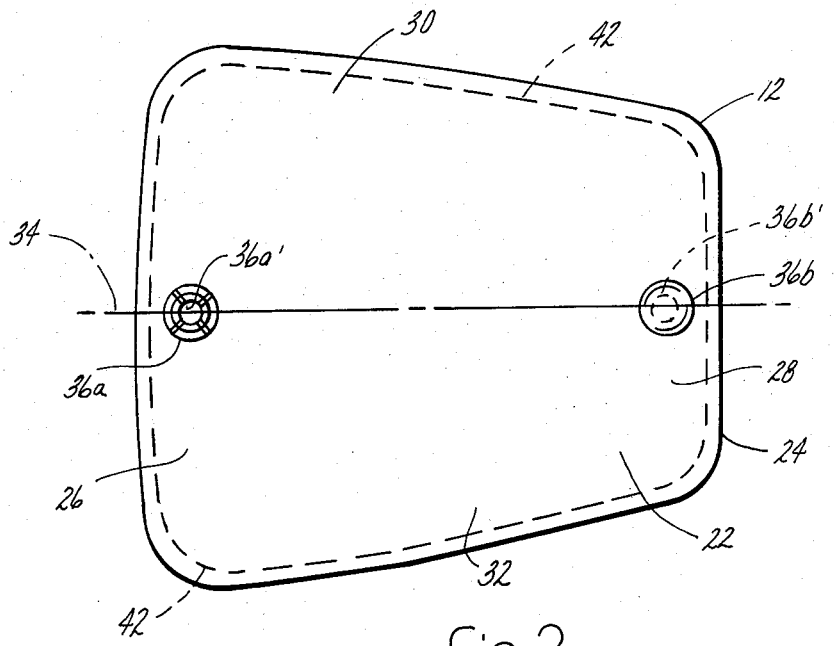
FIG. 2 is a plan view of the front face of one of the individual pieces of the belt of FIG. 1 shown by itself.

FIG. 2 illustrates in detail one of the individual pieces 12 of belt 10. Piece 12 is constructed from a pliant material 22 of generally uniform thickness, for example leather. Plastics or other materials are also considered to be suitable.

The material 22 comprises a perimeter edge 24 which has end portions 26, 28, and side edge portions 30, 32. The illustrated piece is symmetrical about an imaginary center line 34 which essentially bisects end edge portions 26 and 28. Although the end edge portions are shown to have slight curvatures, and although the individual elements in the belt when worn will assume a shape such as shown in FIG. 1, it may be fairly said that the end edge portions 26 and 28 assume substantially vertical orientations when the belt is being worn. The side edge portions 30 and 32 endow the material 22 with a tapered shape, with the taper narrowing from end edge portion 26 in the direction of end edge portion 28. Because of the symmetrical character, the taper is essentially the same along both side edge portions. The taper which has been imparted to the individual pieces assists in conforming the belt to the individual.

Successive pieces 12 are connected together by swivel fastening devices 36. The illustrated fastening device comprises a snap type fastener having two separably connected parts **36*a*, 36*b*. The fastening devices 36 lie on the center line 34**.

Each piece 12 comprises one fastening part **36*a* and one fastening part 36*b*. In the disclosed embodiment the fastening part 36*a* is provided on end edge portion 26. Each part 36*a* has a receptacle 36*a'* into which a projecting tip 36*b'* of part 36*b*** snap fits.

Immediately successive pieces 12 are connected together by overlapping the end edge portion 28 of one piece 12 with the end edge portion 26 of the immediately succeeding piece and snapping the corresponding tip **36*a'* into the corresponding receptacle 36*b'*. As can be seen in the belt as worn, the end edge portion 28 lies on the outside of the end edge portion 26 with which it is connected by the snap fit. Therefore the outward appearance which is presented by each fastening device is merely the head of the part 36*a*, and these can be of decorative appearance. Each device 36 enables the two pieces which it connects to swivel about the axis 38** of the snap-fitted tip and receptacle.

By virtue of the swivel connection provided by each device 36 and the tapered shapes of the individual pieces 12, it becomes possible for the belt to assume the general configuration illustrated in FIG. 1, as well as a certain range of variations from this basic configuration. Thus the invention is well adapted to suit an individual's shape without the need for making any modification to the belt.

With the use of the snap type connections to provide the swiveling, it is contemplated that such a belt will be principally decorative in character rather than principally article-supporting. Other types of connections however could render the belt capable of being more tightly tensioned to perform a supporting function if desired.

The illustrated embodiment comprises thirteen such pieces 12 for a girth of essentially thirty-six inches.

It will be appreciated that there may be some variation in the particular number and size and shape of the individual pieces which are still within the scope of the invention. Thus for an approximate thirty-six inch girth, it is contemplated that a range of between eleven and fifteen, inclusive, of the individual pieces are suitable. The use of thirteen in the illustrated embodiment of FIG. 1 and FIG. 2 is for a piece size in which the lengths of the edge portions are essentially as follows, excluding the rounding of the corners:

End edge portion 28: two inches
End edge portion 26: three inches
Side edge portions 30, 32: 3¼ inches
Distance between snap parts **36*a*, 36*b***: three inches.

Figure 3:
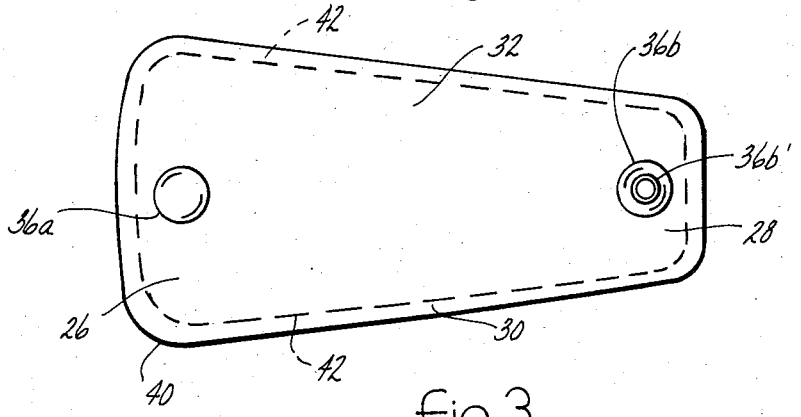
FIG. 3 is a view similar to FIG. 2 but illustrating the rear face of an alternate embodiment of individual piece.

FIG. 3 illustrates a modified form 40 wherein the three inch spacing distance between the snap portions **36*a*, 36*b* is retained but where both end edge portions 26 and 28 are made smaller. In the FIG. 3 embodiment the end edge portion 28 is essentially one inch in length while the end edge portion 26** is approximately one and one-half inches, excluding rounding of the corners.

As noted above, the material may be any suitable one which has pliability and these include leather and certain plastics. Various forms of decoration may be imparted to the pieces. The decoration may be inherent in the material itself and/or may be added. Examples of decoration include, welting, graining, coloring, stitching, etc. FIGS. 2 and 3 show the use of decorative stitching indicated by the reference numeral 42. It is also possible to emboss, imprint, inscribe, hot stamp, or otherwise impart decoration and/or indicia to the individual pieces, such as for example shown by certain of the pieces in FIG. 1 containing geographical inscriptions.

It is contemplated that a belt may be sold in an individual package comprising a particular number of the individual pieces, thirteen as in the example of the preferred embodiment. Because of the nature of the invention, the belt can be packaged as a stack of individual pieces 12.

Figure 4:
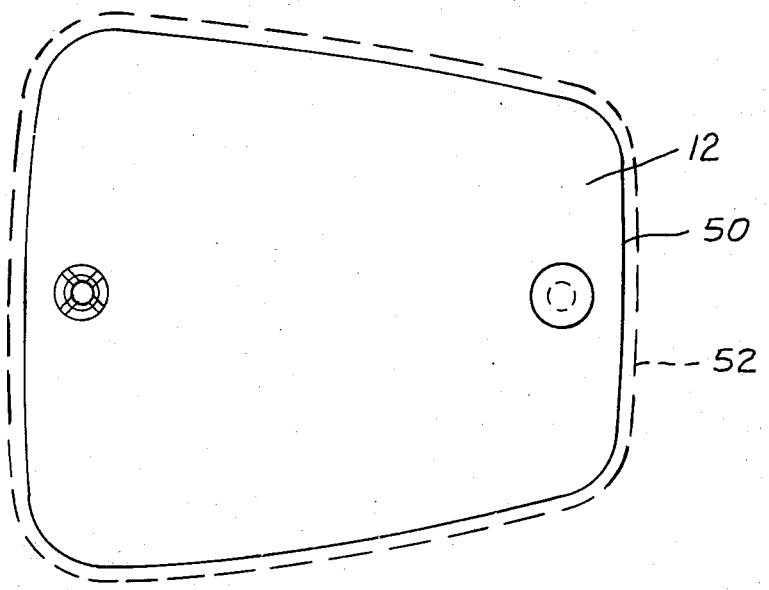
FIGS. 4 and 5 are plan and elevational views illustrating a packaged stack of individual pieces.
Figure 5:
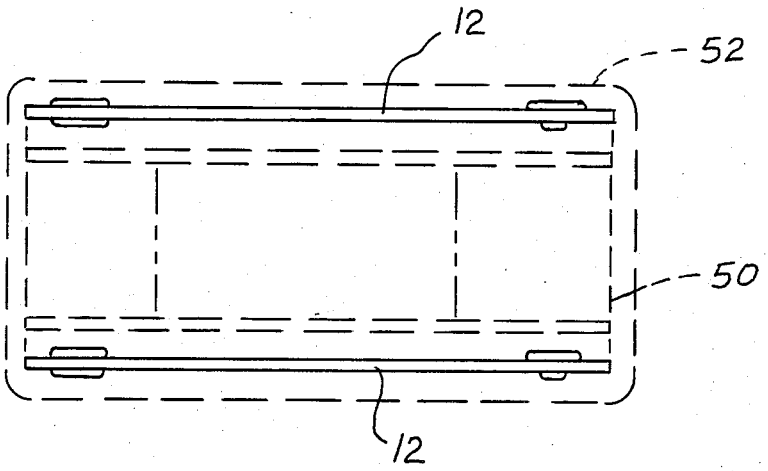

FIGS. 4 and 5 illustrate a stack 50 of individual pieces 12 in a package 52. The pieces of a belt may have the same or different patterns. It is also possible to offer the pieces individually with particular unique designs, logos or otherwise on them. Thus various designs may be created in a belt at the preference of the individual purchaser. The belt is also inherently reversible and can have different color and/or design on one side from that on the other side.

While a preferred embodiment of the invention has been disclosed, it will be appreciated that principles are applicable to other embodiments.

What is claimed is:

1. A hip belt comprising a number of substantially similar pieces successively connected, each piece possessing a pliant construction of substantially uniform thickness and having a perimeter edge comprising two side edge portions and two end edge portions, said end edge portions having their lengths generally vertically disposed when the belt is being worn around the hips, one of said end edge portions of each piece being greater in length than the other end edge portion of the same piece, said side edge portions extending between said end edge portions to impart a taper to each piece which narrows in the direction from said one end edge portion to said other end edge portion thereof, and each pair of immediately successive pieces being connected together by one piece of each such pair of pieces having its other end edge portion overlapping the one end edge portion of the other piece of each such pair of pieces, and a swivel fastening device connecting each such pair of pieces at their overlapping end edge portions at a location which is essentially at the middle of the lengths of such overlapping end edge portions such that the two pieces of each such pair of pieces can swivel relative to one another about an axis passing through the swivel fastening device, which axis is generally horizontal when the belt is worn, each such swivel fastening device being a snap fastener having two separable parts snapped together, one of said parts of such a snap fastener being affixed to said one piece of each such pair of pieces at said other end edge portion therof and the other of said parts of the same snap fastener being affixed to said other piece of each such pair of pieces at said one end edge portion thereof, said one piece of each such pair of pieces containing one of said parts of another snap fastener at said one end edge portion thereof snap fastening with the other of said parts of the same another snap fastener contained in an immediately succeeding piece at said other end edge portion thereof, and said other piece of each such pair of pieces containing one of said parts of a further snap fastener at said other end edge portion thereof snap fastening with the other of said parts of the same further snap fastener contained in an immediately succeeding piece at said one end edge portion thereof.

2. A hip belt as set forth in claim 1 wherein the distance along the length of the belt between immediately succeeding swivel fastening devices is essentially three inches.

3. A hip belt as set forth in claim 1 in which the overall length of each piece along the length of the belt is between three and four inches.

4. A hip belt as set forth in claim 3 in which the length of said one end edge portion is essentially three inches and the length of said other end edge portion is essentially two inches.

5. A hip belt as set forth in claim 3 in which the length of said one end edge portion is essentially one and one-half inches and the length of said other end edge portion is essentially one inch.

6. A hip belt as set forth in claim 1 in which the lengths of said side edge portions are essentially three and one quarter inches each, the length of said one end edge portion is essentially three inches and the length of said other end edge portion is essentially two inches.

7. A hip belt as set forth in claim 1 in which the belt consists of between eleven and fifteen inclusive of said pieces for a thirty-six inch girth of wearer, as measured around the length of the belt.

8. A hip belt as set forth in claim 1 in which each pair of immediately succeeding pieces have said other end portion of said one piece of each such pair of pieces overlapping said one end edge portion of said other piece of each such pair of pieces on the outside of the belt as worn by the wearer.

9. A hip belt as set forth in claim 1 in which the taper is uniform along both side edge portions.

10. A hip belt as set forth in claim 1 in which the belt, as worn, comprises side regions supported by the hips of the wearer and front and back regions supported from said side regions, said front and back regions having downward curvatures.

11. A hip belt as set forth in claim 1 in which the snap fastener part at said one end edge portion of each said pieces is different from the snap fastener part at said other end edge portion of the same piece.

12. A hip belt as set forth in claim 11 in which each snap fastener comprises one of its two parts being a receptacle and the other being a projection, and in which the snap fastener part at said one end edge portion of each said piece is the type comprising a receptacle and the snap fastener part at said other end edge portion of the same piece is the type comprising a projection.

13. A hip belt as set forth in claim 1 in which each snap fastener comprises one of its two parts being a receptacle and the other being a projection.

14. A hip belt as set forth in claim 13 in which the snap fastener part at said one end edge portion of each said piece is the type comprising a projection and the snap fastener part at said other end edge portion of the same piece is the type comprising a receptacle.

15. A hip belt as set forth in claim 14 in which said other piece of each such pair of pieces overlaps said one piece of the same pair on the outside of the belt as worn.

16. A piece for use in forming a portion of the length of a hip belt comprising a pliant piece of material having a perimeter edge which comprises side edge portions and end edge portions, one of said end edge portions being greater in length than the other, said side edge portions extending between said end edge portions to impart to the piece a taper which narrows in the direction from said one edge portion to said other edge portion, a snap fastener half essentially at the middle of the length of said one end edge portion and a complementary snap fastener half essentially at the middle of the length of said other end edge portion.

17. A piece as set forth in claim 16 in which the distance between said snap fastener halves is essentially three inches.

18. A plurality of pieces as set forth in claim 16 stacked together in a package.

19. A plurality of pieces as set forth in claim 16 successively connected by the snap fastener halves.

* * * * *